US007163044B2

(12) United States Patent
Kirby

(10) Patent No.: US 7,163,044 B2
(45) Date of Patent: Jan. 16, 2007

(54) SHADE FOR SHAPED WINDOWS

(75) Inventor: David A. Kirby, Emmaus, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 111 days.

(21) Appl. No.: 10/766,708

(22) Filed: Jan. 27, 2004

(65) Prior Publication Data

US 2005/0161174 A1 Jul. 28, 2005

(51) Int. Cl.
*A47G 5/02* (2006.01)

(52) U.S. Cl. ..... 160/262; 160/56; 160/352; 160/DIG. 11

(58) Field of Classification Search ..... 160/108, 160/120, 121.1, 132, 262, 352, 238, 56, DIG. 11; 248/254, 255, 260
See application file for complete search history.

(56) References Cited

U.S. PATENT DOCUMENTS

| | | | | | |
|---|---|---|---|---|---|
| 565,192 | A | * | 8/1896 | Waterhouse | 160/56 |
| 774,641 | A | * | 11/1904 | Barkhurst | 160/88 |
| 977,565 | A | * | 12/1910 | Smith | 160/56 |
| 1,375,805 | A | * | 4/1921 | Umphrey | 211/105.2 |
| 1,562,355 | A | * | 11/1925 | Manassa | 160/56 |
| 1,677,581 | A | * | 7/1928 | Cohen | 160/81 |
| 2,261,141 | A | * | 11/1941 | Davis | 160/352 |
| 2,506,160 | A | * | 5/1950 | Martin et al. | 248/255 |
| 2,650,714 | A | * | 9/1953 | Brose et al. | 211/105.1 |
| 2,738,154 | A | * | 3/1956 | Mason | 248/255 |
| 3,075,805 | A | | 1/1963 | Golde et al. | 296/137 |
| 3,092,174 | A | * | 6/1963 | Winn | 160/262 |
| 4,550,758 | A | * | 11/1985 | Johnson et al. | 160/271 |
| 4,684,095 | A | * | 8/1987 | Athey | 248/255 |
| 2003/0116997 | A1 | | 6/2003 | Lin | |

FOREIGN PATENT DOCUMENTS

| | | |
|---|---|---|
| EP | 1 167 097 | 1/2002 |
| FR | 2 857 689 A | 7/2003 |
| WO | WO 03/013887 A | 2/2003 |
| WO | WO 03/024729 A | 1/2005 |

* cited by examiner

*Primary Examiner*—David Purol
(74) *Attorney, Agent, or Firm*—Drinker Biddle & Reath LLP

(57) ABSTRACT

A roller shade assembly includes a drape bar extending adjacent a rotatably supported roller tube to suspend a portion of a flexible shade fabric windingly received by the roller tube. The drape bar includes a fabric-receiving portion that is shaped along at least a portion of its length to be non-linear so that the suspended portion of the shade fabric defines a curve across its width. The fabric-receiving portion of the drape bar may be continuously curved. Alternatively, the fabric-receiving portion may include substantially straight segments each longitudinally misaligned with adjacently located segments.

3 Claims, 7 Drawing Sheets

SHADE FOR SHAPED WINDOWS

FIELD OF THE INVENTION

The present invention relates to shades for use with a window, or a set of windows, that are non-planar.

BACKGROUND OF THE INVENTION

Conventional roller shades include an elongated roller tube engaging a flexible shade fabric at one end of the shade fabric. The roller tube is supported for rotation about a central axis and raises and lowers the other end of the shade fabric with respect to the roller tube as the roller tube is rotated.

The shade fabric is supported by the roller tube such that an unwound portion of the shade fabric including the second end is suspended from the roller tube. The roller tube is generally in the shape of a right circular cylinder. Shade fabrics typically include a hem bar secured adjacent the second end for weighting the suspended portion of the shade fabric. The hem bar is straight, to run parallel to the axis of the cylinder. Suspended by the roller tube in this manner, the unwound portion of shade fabric is substantially planar across the width of the shade fabric.

Suspending the unwound portion of the shade fabric from the roller tube such that it hangs in a planar fashion is appropriate for shading a window, or a set of windows, that are also planar. However, where the window or windows are not planar but are curved or form a bay window, the planar shade fabric does not match the shape of the window. Shading of a curved window using prior art roller shades would require multiple roller tubes arranged end-to-end in non-linear fashion to approximate the curvature of the window. Multiple roller tubes supporting multiple shades, however, undesirably introduce light gaps between shades and may also complicate installation because of the need for separate support of the individual multiple roller tubes. In addition, where the cross section defined by the window is curved, the coverage provided by the prior art roller shades would be only a gross approximation unless a large number of roller shades were used.

SUMMARY OF THE INVENTION

According to the present invention, a roller shade assembly includes a rotatably supported roller tube windingly receiving a flexible shade fabric. A drape bar shaped along at least a portion of its length to be non-linear is located near the roller tube to slidingly support the shade fabric so that a portion of shade fabric is suspended from the bar.

According to one embodiment of the invention, the drape bar is curved along at least a fabric-receiving portion of the drape bar so that the suspended portion of the shade fabric defines a curve across a width of the shade fabric.

According to another embodiment of the invention, the curve of the drape bar is defined by a plurality of substantially straight segments, each longitudinally misaligned with adjacent segments of the bar.

According to a further embodiment of the invention, the fabric-receiving portion of the drape bar is oriented at an angle, θ, to the horizontal. The fabric-receiving portion of the drape bar defines an arc depth, A, between its opposite ends and an intermediate location between them. The drape bar is supported such that each of the ends of the fabric-receiving portion of the drape bar are located at a distance, D, from the roller tube. The values of A, D, and θ are related to each other according to the equation:

$$(A+D)^2+(A\tan\theta)^2=[A\tan\theta+D]^2.$$

According to another embodiment, the roller shade includes a flexible shade with a hem bar extending along an end edge thereof. The hem bar is preferably formed along its length to define a curved profile.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown. In the drawings.

DETAILED DESCRIPTION OF THE DRAWINGS

Figure 1:
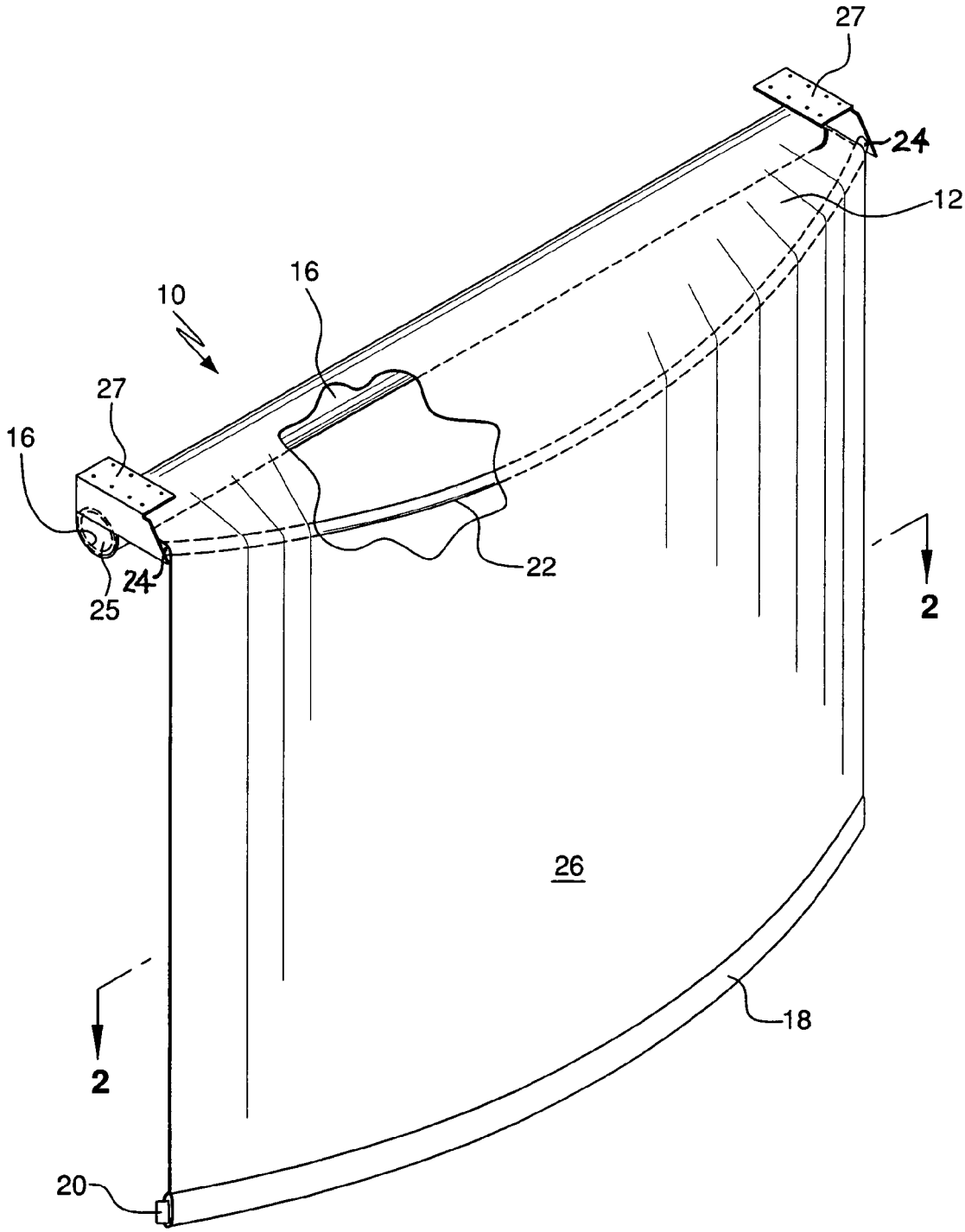
FIG. 1 is a perspective view of a roller shade assembly according to the present invention supporting a flexible shade fabric.
Figure 2:
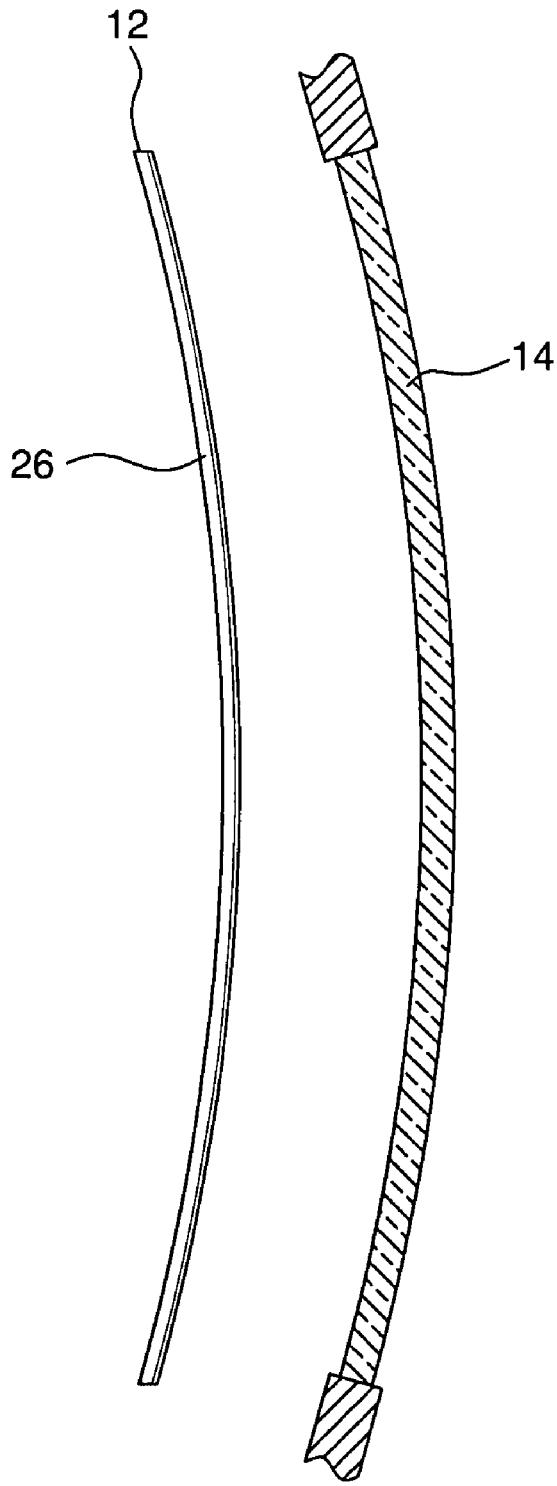
FIG. 2 is a sectional view taken along the line 2—2 of FIG. 1 illustrating a curved suspended portion of the flexible shade of FIG. 1 adjacent a correspondingly curved window.

Referring to the drawings, where like numerals identify like elements, there is illustrated in FIGS. 1 and 2 a roller shade assembly 10 according to the present invention. The roller shade assembly 10 supports a flexible shade fabric 12 so that the shade fabric defines a curved cross section for shading a window 14 having a correspondingly curved cross section.

The roller shade assembly 10 includes a roller shade comprising an elongated roller tube 16 to which the shade fabric 12 is attached. The roller tube 16 is supported in known manner for rotation about a central axis for winding the shade fabric 12 onto the roller tube 16, thereby raising and lowering a lower end 18 of the shade fabric 12 with respect to the roller tube 16 as the shade fabric 12 is wound or unwound, respectively. An elongated hem bar 20 is secured to the shade fabric 12 along the lower end 18. The hem bar 20 weights the shade fabric 12 to enable the shade fabric 12 to be wound and unwound with limited wrinkling of the shade fabric. The hem bar 20 is illustrated as being curved along its length such that its curvature substantially matches the curvature of the window 14, although it need not be shaped that way.

Figure 3:
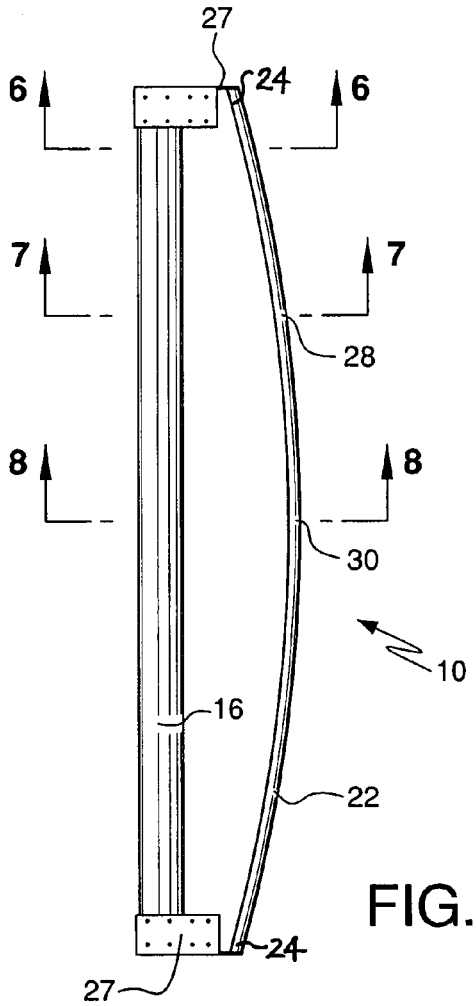
FIG. 3 is a top view of a roller shade assembly according to the present invention.
Figure 5:
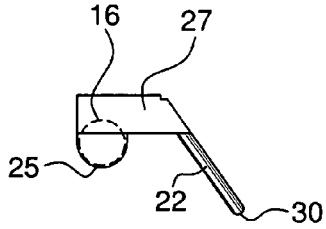
FIG. 5 is an end view of the roller shade assembly of FIG. 3.
Figure 4:
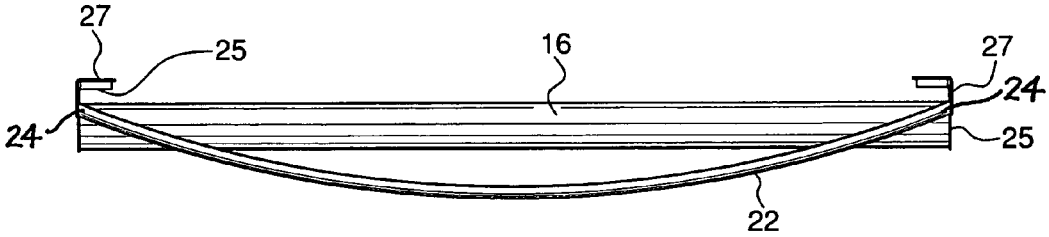
FIG. 4 is a side view of the roller shade assembly of FIG. 3.

Referring to FIGS. 3–5, the roller shade assembly 10 also includes an elongated drape bar 22 supported at opposite ends 24. The drape bar 22 is located with respect to the roller tube 16 to extend adjacent to it and to slidingly receive the shade fabric 12 over a top surface as the shade fabric 12 is wound and unwound from the roller tube 16. The sliding receipt of the shade fabric 12 over the drape bar 22 in this manner suspends portion 26 of the shade fabric 12 from the drape bar 22 and imparts the desired curvature to the unwound portion 26.

The top surface of the fabric-receiving portion of the drape bar 22 curves in the top view shown in FIG. 3 to impart the desired curvature in the suspended portion of the shade fabric 12. The top surface of the fabric-receiving portion of the drape bar 22, however, also curves in the side view shown in FIG. 4. As will be described in more detail, in order for the shade fabric to hang evenly across the width of the shade, the fabric length between the lower end 18 of the shade fabric 12 and the roller tube 16 should be substantially constant across the width of the shade fabric 12. The above-described curvature in both the top and side views as shown in FIGS. 3 and 4, respectively, provides for substantially constant fabric length across the width of the shade fabric 12.

The roller shade assembly 10 includes a roller tube bracket 25 and a drape bar bracket 27 at each end of roller shade assembly 10. Referring to the end view illustrated in FIG. 5, the drape bar brackets 27 provide for mounting of the drape bar 22 to a fixed support, such as a ceiling for example, such that the drape bar 22 is substantially oriented at an angle to the horizontal. This orientation provided by the drape bar brackets 27 provides for the desired curvature of the fabric-receiving portion of the drape bar 22 in both the top and side views of FIGS. 3 and 4. Each drape bar bracket 27 includes a pair of plates oriented substantially perpendicular to each other. The drape bar 22 is secured at each of opposite ends to a lower one of the plates of the drape bar brackets 27. As shown in FIGS. 1 and 3, the upper plate of each of the drape bar brackets 27 includes openings for mounting of the bracket 27 to a fixed support, such as a ceiling for example, using suitable fasteners. The drape bar 22 and the drape bar brackets 27 are preferably made from metal and secured together by welding. The present invention, however, is not limited to any particular materials.

The opposite ends of the roller tube 16 are located adjacent the roller tube brackets 25. In a known manner, the roller tube 16 is rotatably supported by the roller tube brackets 25 such as by tube end couplers (not shown) engaging opposite ends of the tube and received by openings in the brackets. As shown in FIG. 3, the openings in the upper plate of the drape bar brackets 27 extend across the upper plate to provide for attachment of the roller tube brackets 25 to the drape bar brackets 27, using suitable fasteners, as well as attachment of the drape bar brackets 27 to a fixed support.

Figure 6:
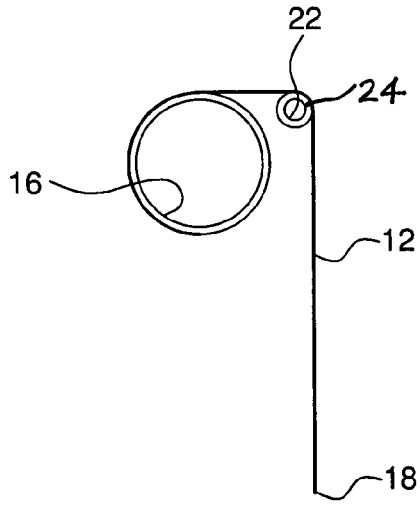
FIG. 6 is a sectional view taken along the line 6—6 of FIG. 3 with a supported shade shown in broken line.
Figure 7:
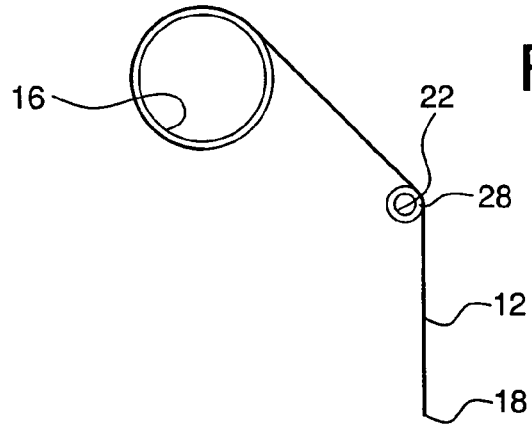
FIG. 7 is a sectional view taken along the line 7—7 of FIG. 3.
Figure 8:
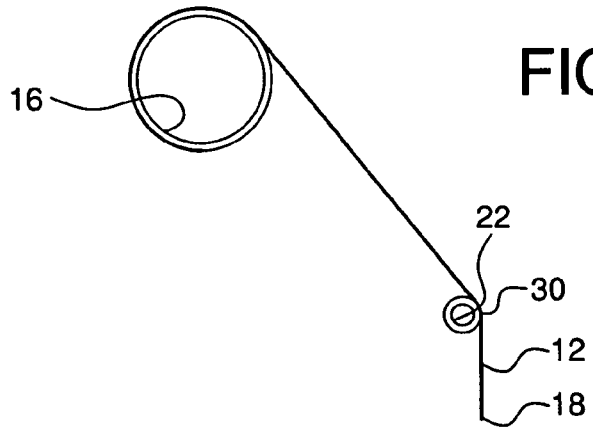
FIG. 8 is a sectional view taken along the line 8—8 of FIG. 3.

Referring to FIGS. 6–8, the variation in the relative locations of the drape bar 22, the roller tube 16 and a shade fabric 12 across the width of the shade fabric 12 is illustrated. The relative locations are respectively illustrated in FIGS. 6–8 adjacent the ends 24 of the drape bar 22, at an intermediate point 28 between the ends and a center point 30 of the drape bar 22, and at the center point 30 of the drape bar 22. As shown in FIG. 6, the drape bar 22 and the received shade fabric 12 are located in a relatively higher position adjacent the ends of the drape bar 22 as compared to the drape bar 22 and shade fabric 12 at the intermediate and center points 28, 30 of FIGS. 7 and 8. As is also shown, the drape bar 22 and shade fabric 12 are located relatively close to the roller tube 16 adjacent the ends of the drape bar 22 as compared to the drape bar 22 and shade fabric 12 at the intermediate and center points 28, 30 of FIGS. 7 and 8. As shown by comparing FIGS. 6–8, the drape bar 22 and received shade fabric 12 are located progressively lower at the intermediate and center points 28, 30.

As described below, the support of the shade fabric 12 by the drape bar 22 in the manner illustrated in FIGS. 6–8 provides for substantially constant fabric length across the width of the shade fabric 12 so that the suspended portion 26 of the shade fabric 12 hangs evenly with the lower end 18 substantially horizontal across the width of the shade fabric 12. The present invention does not require hem bar 20 at the lower end 18 of the shade fabric 12. The curvature of the drape bar 22 would still provide the desired curvature of the suspended portion 26 of the shade fabric 12 in the absence of the hem bar 20. However, the hem bar 20, if included, is preferably curved, as shown, to substantially match the curvature in the shade fabric 12 provided by the drape bar 22.

Figure 9:
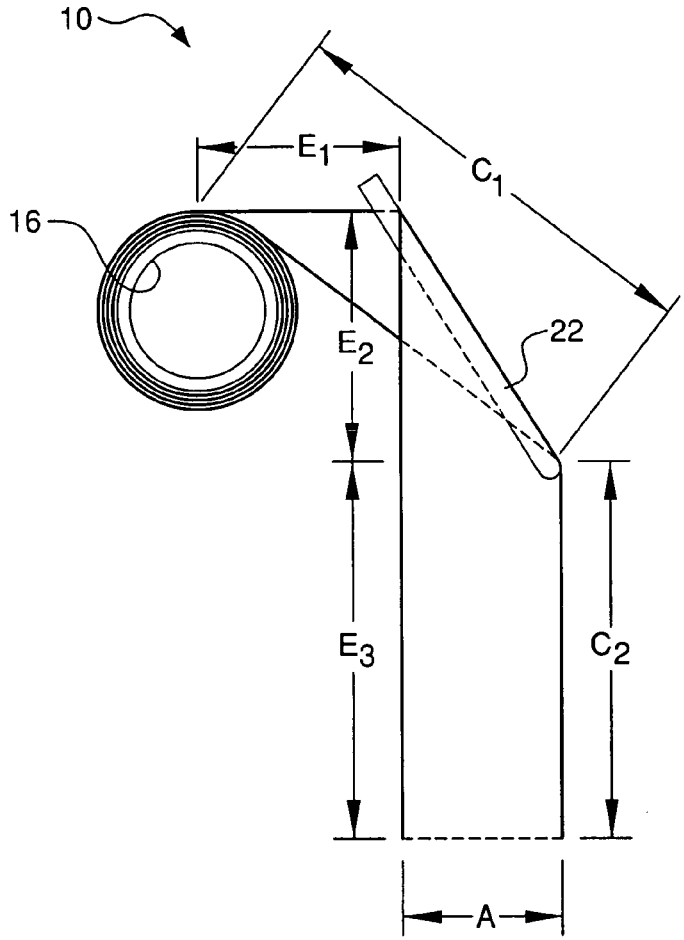
FIG. 9 is a schematic illustration of a roller shade assembly according to the present invention.

Referring to FIG. 9, the roller shade assembly 10 and a supported shade fabric 12 are illustrated schematically. The shade fabric 12 is represented by two sets of line segments. The first set of line segments, representing one of the side edges of the shade fabric, includes line segments $E_1$, $E_2$ and $E_3$. The second set of line segments, representing a center line extending along the shade fabric between the opposite side edges of the shade fabric, includes line segments $C_1$ and $C_2$. Segment $C_1$ represents the length of fabric between the roller tube 16 and the drape bar 22. Segment $C_2$ of the center line represents the length of fabric in the suspended portion of the shade fabric between the drape bar 22 and the lower end 18 of the shade fabric 12. Segment $E_1$ of the first set represents the length of fabric between the roller tube 16 and the drape bar 22. The distance between the drape bar 22 and the lower end 18 of the shade fabric at the side edge is represented by segments $E_2$ and $E_3$. Segment $E_2$ represents the portion of the suspended shade fabric along its side edge that is located above the center point 30 of drape bar 22. Segment $E_3$ represents the remaining portion of the side edge that is located below the center point 30 of drape bar 22. Line segments $E_3$ and $C_2$, therefore, are of equal length.

As described above, the drape bar 22 is located and oriented with respect to the roller tube 16 such that the fabric length between the lower end 18 of the shade fabric 12 and the roller tube 16 is constant at any point across the shade fabric 12. Therefore, the sum of the lengths of line segments $E_1$, $E_2$ and $E_3$ will be equal to the sum of the lengths of $C_1$ and $C_2$. As described above, however, the length of line segment $C_2$ is equal to the length of line segment $E_3$. Therefore, the sum of the lengths of line segments $E_1$ and $E_2$ will be equal to the length of line segment $C_1$.

Figure 10:
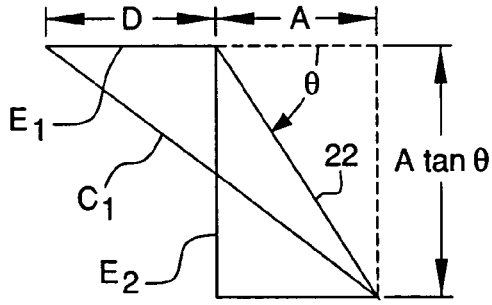
FIG. 10 is a schematic illustration of shade support geometry of the roller shade assembly of FIG. 9.

Referring to FIG. 10, the geometry associated with the roller shade assembly 10 and the shade fabric 12 is illustrated with the roller tube 16 removed and the drape bar 22 shown as a line for clarity. As shown, the drape bar 22 is located such that the curved surface of the drape bar 22 is oriented at an angle, $\theta$, from the horizontal. Also, the distance, shown as D, between the roller tube 16 and the drape bar 22 where the side edges of the shade fabric 12 are received by the drape bar 22 is equal to the length of line segment $E_1$ in FIG. 9. The depth of the desired arc to be formed in the suspended portion of the shade fabric, shown as A, is equal to the distance between line segments $C_2$ and $E_3$ in FIG. 9. Therefore, the height that is occupied by the fabric-receiving portion of the angled drape bar 22, which was represented in FIG. 9 by $E_2$, is equal to A tan θ. As described above, however, $C_1$ is equal to the sum of $E_1$ and $E_2$ for maintaining constant fabric length across the width of the shade fabric. Therefore, $C_1$ must be equal to the sum of D and A tan θ.

Using the Pythagorean theorem for the right triangle of FIG. 10 that includes $C_1$ as its hypotenuse, the variables A, D and θ are related to each other by the following equation:

$$(A+D)^2+(A \tan \theta)^2=[A \tan \theta+D]^2$$

For example, for a roller shade assembly 10 having a desired arc depth (e.g., A) equal to 4 inches and a drape bar 22 oriented at an angle, θ, equal to 55 degrees, the variable D according to the above equation will be equal to 4.7 inches. Therefore, the given drape bar 22 should preferably be located such that an attached shade fabric 12 slidingly received on the drape bar 22 will contact the drape bar 22 at the opposite side edges of the shade fabric 12 at a distance of approximately 4.7 inches from the roller tube 16.

With the roller shade assembly 10 including a curved drape bar 22 located with respect to the roller tube 16 according to the above equation, the suspended portion of a shade fabric 12 will hang evenly and substantially follow the desired curvature at each point across the width of the shade. As described above, the drape bar 22 of roller shade assembly 10 is simply curved (i.e., only curved with respect to one axis along its length). The drape bar 22 could be complexly curved (i.e., also curved with respect to a second axis to no longer appear as a line in an end view as shown in FIG. 10) in order to provide for an exact fit at each point across the shade fabric 12. It has been found however, that the fabric lengths at the center and side edges using a complexly curved drape bar will not vary noticeably from that provided using a simply curved drape bar according to the above equation.

As shown in FIGS. 1–5 and described above, the roller shade assembly 10 preferably includes brackets 27 secured to opposite ends of the drape bar 22 for mounting the drape bar 22 to a ceiling. The present invention is not limited to this construction, however. A drape bar, for example, having a fabric-receiving portion curved in the desired manner shown in FIGS. 3 and 4 and supported at the desired distance from the roller tube 16, could include terminal end portions that vary in construction from that shown for mounting to a fixed support at a different location than that provided by brackets 27.

Figure 11:
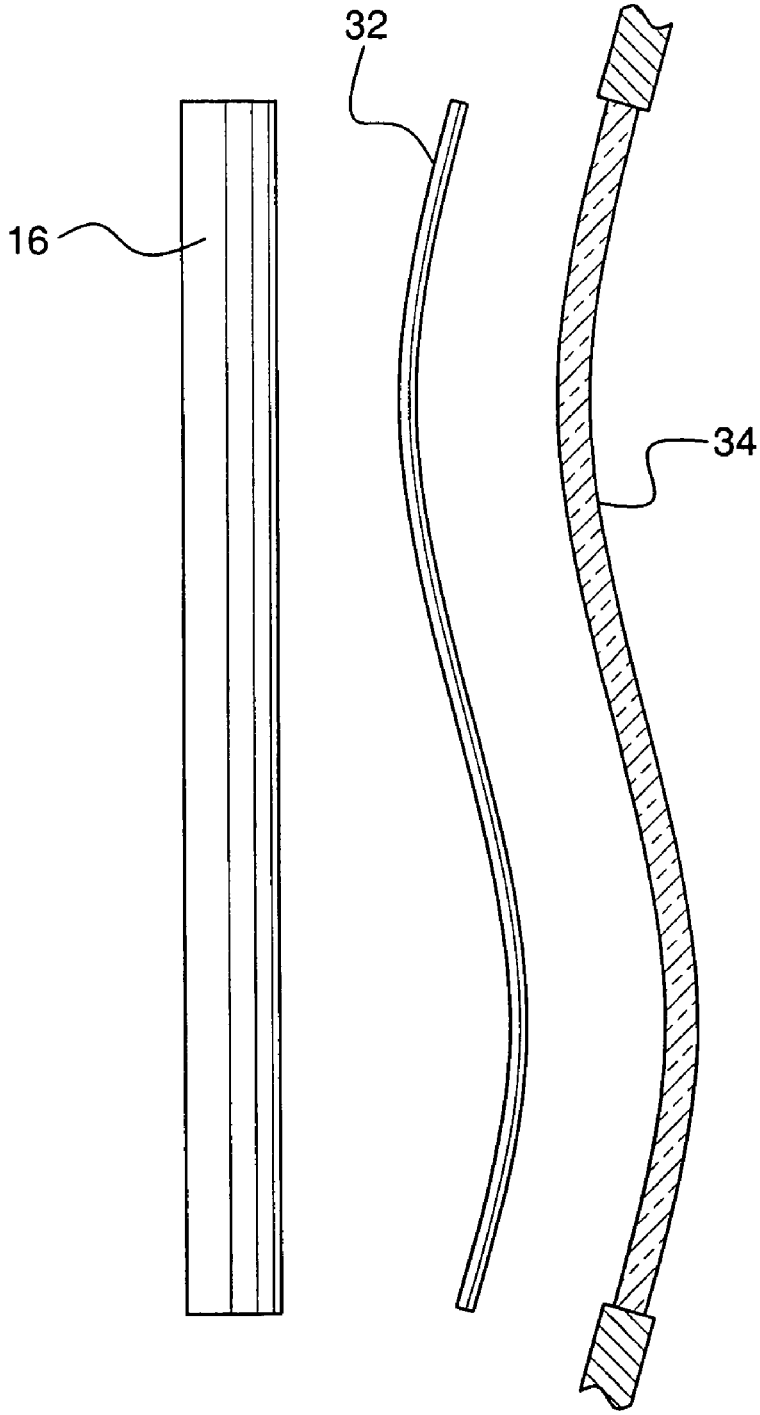
FIG. 11 is a top view, partly in section, of a roller shade assembly including a drape bar according to one embodiment of the invention.
Figure 12:
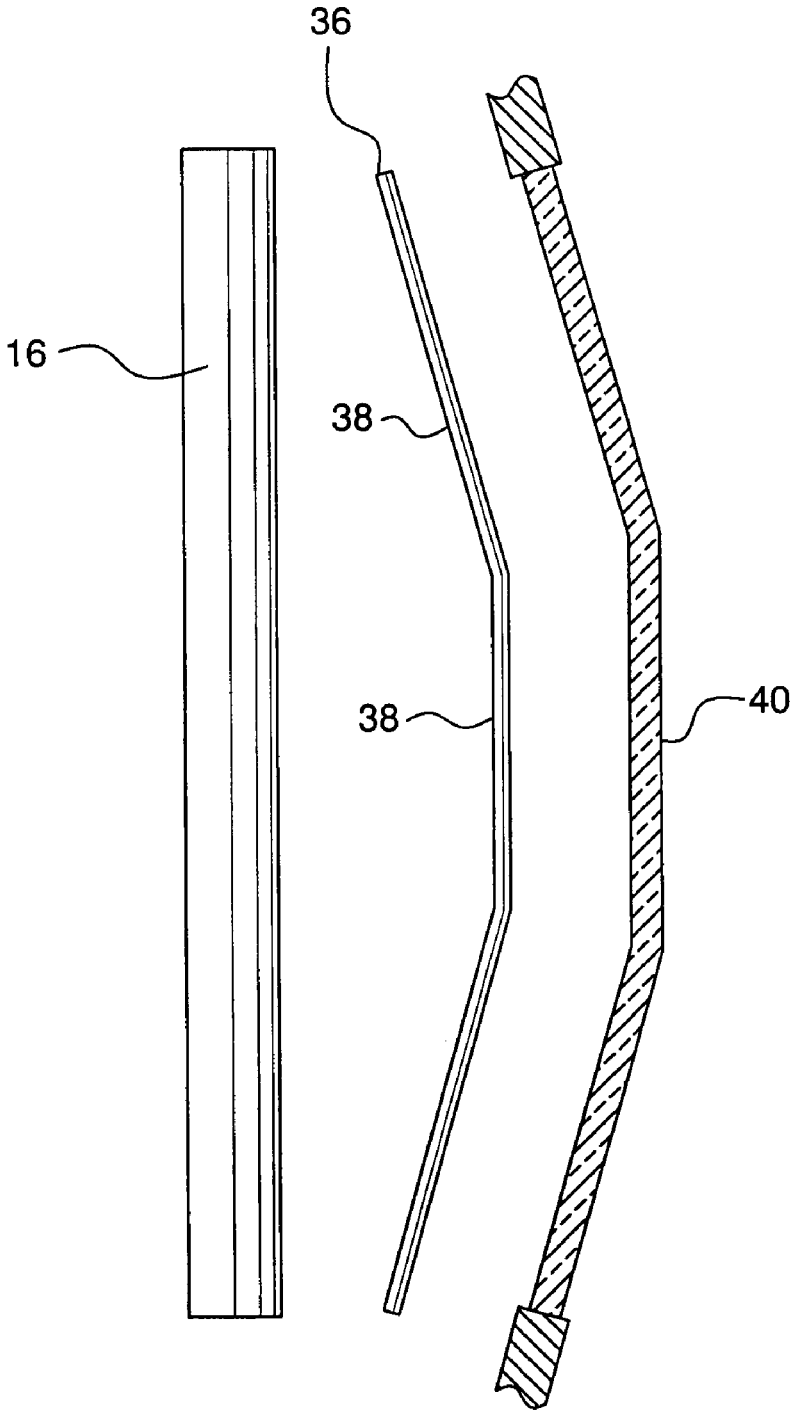
FIG. 12 is a top view, partly in section, of a roller shade assembly including a drape bar according to another embodiment of the invention.

The present invention is also not limited to a drape bar including a fabric-receiving portion having the particular curved configuration shown in FIGS. 3 and 4. Referring to FIGS. 11–12, drape bars according to the present invention could include fabric-receiving portions having other curved shapes. As shown in the top view of FIG. 11, a drape bar 32 could be shaped to define an S-shaped profile for shading a correspondingly formed window 34.

Each of the curved drape bar shapes described above includes continuously curved portions. The present invention, however, is not limited to drape bars having continuously curved shapes. As shown in FIG. 12, for example, a drape bar 36 could be formed to comprise straight segments 38 that are not aligned with one another. As shown, such a configuration would be desirable for shading a bay window 40 with a seamless piece of fabric.

The shade fabrics 12 intended for use with the shaped drape bars of the present invention are rectangular such that the width of the shade fabric is substantially constant along its length. The roller tubes 16 intended for use with the shaped drape bars of the present invention are substantially straight. As described above, the shade fabrics 12 are received by the drape bars to suspend a portion of the shade fabric in a non-planar configuration. It should be clearly understood by those skilled in the art that the side edges of the suspended portion of the shade fabric 12 will be drawn inwardly with respect to the roller tube length as compared with the location of the shade fabric side edges at the roller tube. As a result, the side-to-side aspect of the shade fabric 12 will be reduced because of the non-planar shape imparted to the shade fabric.

The foregoing describes the invention in terms of embodiments foreseen by the inventor for which an enabling description was available, notwithstanding that insubstantial modifications of the invention, not presently foreseen, may nonetheless represent equivalents

What is claimed is:

1. A roller shade assembly comprising:

a rotatably supported roller tube that supports a flexible shade fabric for winding of the shade fabric thereon; and an elongated drape bar curved along at least a fabric-receiving portion of its length, the drape bar extending adjacent the roller tube for sliding receipt of the flexible shade fabric on an upper surface defined by the fabric-receiving portion of the drape bar, the fabric-receiving portion of the drape bar having opposite ends and defining an arc depth, A, between its opposite ends and an intermediate location therebetween, the drape bar supported such that the surface of the fabric-receiving portion is oriented at an angle, θ, from the horizontal, the drape bar located with respect to the roller tube such that each of the ends of the fabric-receiving portion of the drape bar is located at a distance, D, from the roller tube, the values of A, D, and θ related to each other according to the equation:

$$(A+D)^2+(A \tan \theta)^2=[A \tan \theta+D]^2.$$

2. The roller shade assembly according to claim 1, wherein the angle θ is greater than 45 degrees.

3. The roller shade assembly according to claim 2, wherein the angle θ is approximately 55 degrees.

* * * * *